US006372181B1

(12) United States Patent
Fahrmann et al.

(10) Patent No.: US 6,372,181 B1
(45) Date of Patent: Apr. 16, 2002

(54) LOW COST, CORROSION AND HEAT RESISTANT ALLOY FOR DIESEL ENGINE VALVES

(75) Inventors: Michael G. Fahrmann; Gaylord D. Smith, both of Huntington, WV (US)

(73) Assignee: INCO Alloys International, Inc., Huntington, WV (US)

( * ) Notice: Subject to any disclaimer, the term of this patent is extended or adjusted under 35 U.S.C. 154(b) by 0 days.

(21) Appl. No.: 09/934,892

(22) Filed: Aug. 22, 2001

Related U.S. Application Data

(63) Continuation-in-part of application No. 09/663,489, filed on Sep. 18, 2000.
(60) Provisional application No. 60/227,700, filed on Aug. 24, 2000.

(51) Int. Cl.[7] ..... C22C 30/00
(52) U.S. Cl. ..... 420/584.1; 420/586; 420/586.1; 148/442
(58) Field of Search ..... 420/584.1, 586.1, 420/586; 148/442, 419

(56) References Cited

U.S. PATENT DOCUMENTS

| | | | |
|---|---|---|---|
| 4,379,120 A | 4/1983 | Whitney et al. | 420/448 |
| 4,631,169 A | 12/1986 | Isobe et al. | 420/443 |
| 4,867,116 A | 9/1989 | de Freitas Couto Rosa et al. | 123/188 |
| 4,871,512 A | 10/1989 | Takagi et al. | 420/448 |
| 5,567,383 A | 10/1996 | Noda et al. | 420/584 |
| 5,779,972 A | 7/1998 | Noda et al. | 420/54 |
| 5,951,789 A | 9/1999 | Ueta et al. | 148/325 |
| 6,039,919 A | 3/2000 | Nagashima et al. | 420/446 |

FOREIGN PATENT DOCUMENTS

| | | |
|---|---|---|
| CA | 1255927 | 6/1989 |
| EP | 0183536 | 6/1986 |
| JP | 56020148 A * | 2/1981 |

OTHER PUBLICATIONS

Kato, Tetsuo et al., "A New Iron–Base Superalloy for Exhaust Valves," SAE Technical Paper Series No. 810032, *Society of Automative Engineers, Inc.*, (9pp.) Feb. 23–27, 1981.

Kato, Tetsuo et al., "Application of a Newly Developed Iron–Base Superalloy to Exhaust Valves of Diesel Engines", SAE Technical Paper Series No. 830253, *Society of Automotive Engineers, Inc.*,(17pp.) Feb. 28–Mar. 4, 1983.

Larson, J.M. et al., "Engine Valves——Design and Material Evolution", *Journal of Engineering for Gas Turbines and Power*, vol. 109 (7pp.) Oct. 1987.

* cited by examiner

*Primary Examiner*—Deborah Yee
(74) *Attorney, Agent, or Firm*—Robert F. Dropkin, Esq.; Webb Ziesenheim Logsdon Orkin & Hanson, P.C.

(57) ABSTRACT

A low cost, highly heat and corrosion resistant alloy useful for the manufacture of diesel engine components, particularly exhaust valves, comprises in % by weight about 0.15–0.65% C, 40–49% Ni, 18–22% Cr, 1.2–1.8% Al, 2–3% Ti, 0.9–7.8% Nb, not more than 1% Co and Mo each, the balance being essentially Fe and incidental impurities. The Ti:Al ratio is ≦2:1 and the Nb:C weight % ratio is within a range of 6:1 and 12:1. Ta may be substituted for Nb on an equiatomic basis.

12 Claims, 10 Drawing Sheets

LOW COST, CORROSION AND HEAT RESISTANT ALLOY FOR DIESEL ENGINE VALVES

CROSS-REFERENCE TO RELATED APPLICATION

This application is a continuation-in-part application of co-pending U.S. application Ser. No. 09/663,489 filed Sep. 18, 2000, entitled "Low Cost, Corrosion and Heat Resistant Alloy for Diesel Engine Exhaust Valves" now allowed which, in turn, claims the benefit of U.S. Provisional Application Serial No. 60/227,700 filed Aug. 24, 2000, entitled "Low Cost, Corrosion and Heat Resistant Alloy For Diesel Engine Valves".

BACKGROUND OF THE INVENTION

1. Field of the Invention

The present invention relates generally to corrosion and heat resistant alloys and, more particularly, is directed to a Fe—Ni—Cr alloy useful for diesel engine components, primarily exhaust valves. The alloy features a favorable balance of low cost, high-temperature monotonic and fatigue strength, corrosion resistance, and metallurgical stability. The alloy of the present invention may also be usefully employed in the manufacture of other diesel engine parts such as, for example, exhaust train components which experience similarly aggressive environments.

2. Description of the Prior Art

Heretofore, corrosion and heat resistant stainless steels such as 23-8N (Fe-23Cr-2.5Mn-8Ni-0.8Si-0.3C-0.3N) or 21-4N (Fe-21Cr-9Mn-4Ni-0.5C-0.4N) have been widely used for exhaust valves in low to medium performance diesel engines. For high performance engines, in contrast, expensive Ni-base superalloys such as NIMONIC® alloy 80A and alloy 751 have been implemented. Due to the ever-increasing demands on engine operating efficiency and reliability, in recent years the need for low cost, intermediate performance valve alloys has arisen.

With this goal in mind, recently several alloys such as Pyromet® 31V (Fe-56Ni-23Cr-2Mo-1.2Al-2.3Ti-0.8Nb-0.04C, U.S. Pat. No. 4,379,120), a 40 Ni alloy (Fe-41Ni-16Cr-0.9Al-2.8Ti-0.8Nb-0.05C, U.S. Pat. No. 5,567,383), and HI® 461 (Fe-47Ni-18Cr-1.2Al-4.0Ti-0.3C) were developed. Besides lowering the Ni content to the greatest extent possible without compromising the prerequisite strength requirements, special emphasis was placed on high-temperature abrasion resistance, thus eliminating the cost of expensive hardfacing.

Still, the aforementioned alloys exhibit some shortcomings. For example, Pyromet® 31V features a relatively high Ni content and was also found to precipitate a potentially embrittling acicular alpha ($\alpha$)-Cr phase after extended exposures to service temperatures of 760° C. (1400° F.). The 40 Ni alloy is low cost but contains only moderate amounts of Cr, thus impairing corrosion resistance. Furthermore, the alloy seems to be prone to unwanted eta ($\eta$)-phase ($Ni_3Ti$) precipitation upon extended exposure harming ductility. The most favorable balance between cost and performance has, seemingly, been attained with alloy HI® 461 which features a dispersion of primary TiC carbides in addition to the customary gamma prime ($\gamma'$)-strengthening. It was felt, however, that further performance enhancements at the same moderate cost level were still needed in order to achieve even further improvements in engine performance and reliability.

SUMMARY OF THE INVENTION

The present invention is directed to an improved alloy particularly suited for diesel engine exhaust valves and the like which features an attractive balance of low cost, high-temperature monotonic and fatigue strength, corrosion and abrasion resistance, metallurgical stability, and ease of fabrication.

The alloy according to the present invention is characterized by a composition in weight percent of about 0.15–0.65% C, 40–49% Ni, 18–22% Cr, 1.2–1.8% Al, 2.0–3.0% Ti, 0.9–7.8% Nb, not more than 1% Co and Mo each, the balance being Fe and inevitable impurities, whereby the Ti:Al ratio (wt. %) must not exceed 2:1, and the Nb:C ratio (wt. %) is adjusted to lie within the range of 6:1 and 12:1 (or 0.8:1 to 1.5:1 on an atomic basis). A further presently preferred Nb range is 0.9–6.5 wt. % with a Nb:C ratio of between 6:1 and 10:1 on a wt. % basis (or 0.8:1 to 1.3:1 on an atomic basis).

Furthermore, cost permitting, Nb may be partially substituted for Ta on an equiatomic basis. In this case, the ratio of the combined atomic percentage (Nb+Ta) to C present should be adjusted to lie within the range of 0.8–1.5.

The alloy may also contain certain elements essential for deoxidation/desulfurization and improved hot workability in the following amounts: up to 2.0% Mn, up to 0.01% B, and up to 0.3% Zr. Silicon additions up to 1.0 wt. % are also beneficial to improve the alloy's oxidation resistance.

In a more presently preferred embodiment of the invention (in % by weight), the C content is limited to 0.25–0.55%, the Ni content is 42–48%, the Cr content is 19–21%, the Al content is 1.4–1.7%, the Ti content is 2.3–2.7%, the Nb content is 1.8–5.5%, the balance being Fe and inevitable impurities, and wherein the Nb:C weight % ratio is adjusted to lie within the range of 7:1 and 10:1, and the Ti:Al weight % ratio is less than or equal to 2:1. A still more preferred Nb range is about 2.5–3.0%.

The microstructure of the alloy of the present invention features, even after extended exposures to valve operating temperatures in the vicinity of 760° C. (1400° F.), essentially a uniform dispersion of micron size Nb-rich primary MC type carbides, fine discrete Cr-rich secondary $M_{23}C_6$ type carbides in the austenite grain boundaries, and submicroscopic intragranular $\gamma'$ precipitates. Moreover, the microstructure of a preferred embodiment of the invention features less than 5 vol. % of any acicular phase.

The present invention further includes diesel engine valves, particularly exhaust valves, as well as other exhaust train components, manufactured from the above described alloy.

BRIEF DESCRIPTION OF THE DRAWINGS

FIG. 1(*b*) is a graph of tensile elongation versus temperature for Alloys 1–5 of the present invention and several comparative alloys;

DETAILED DESCRIPTION OF THE INVENTION

Figure 1A:
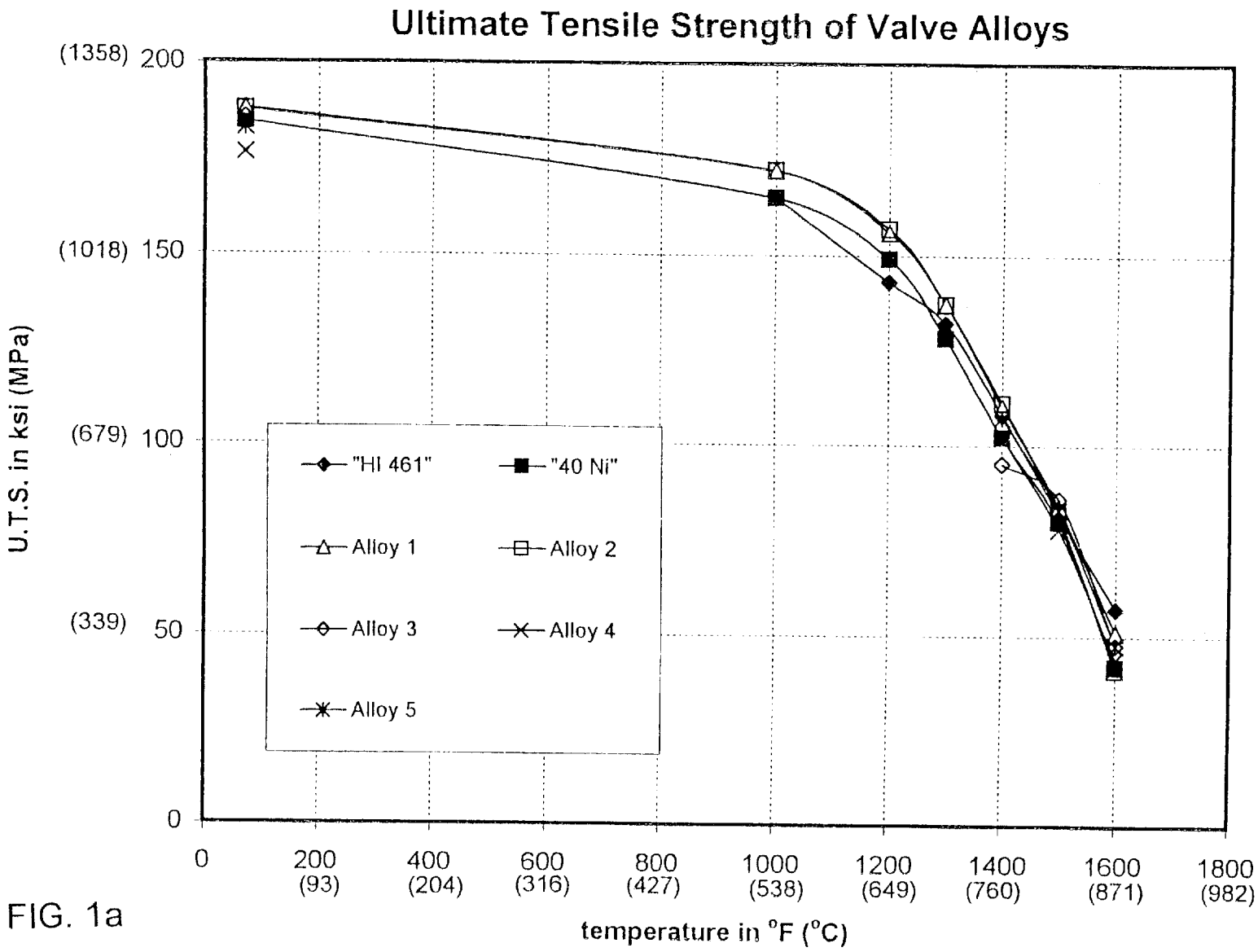
FIG. 1(*a*) is a graph of ultimate tensile strength versus temperature for Alloys 1–5 of the present invention and several comparative alloys of the prior art.
Figure 1B:
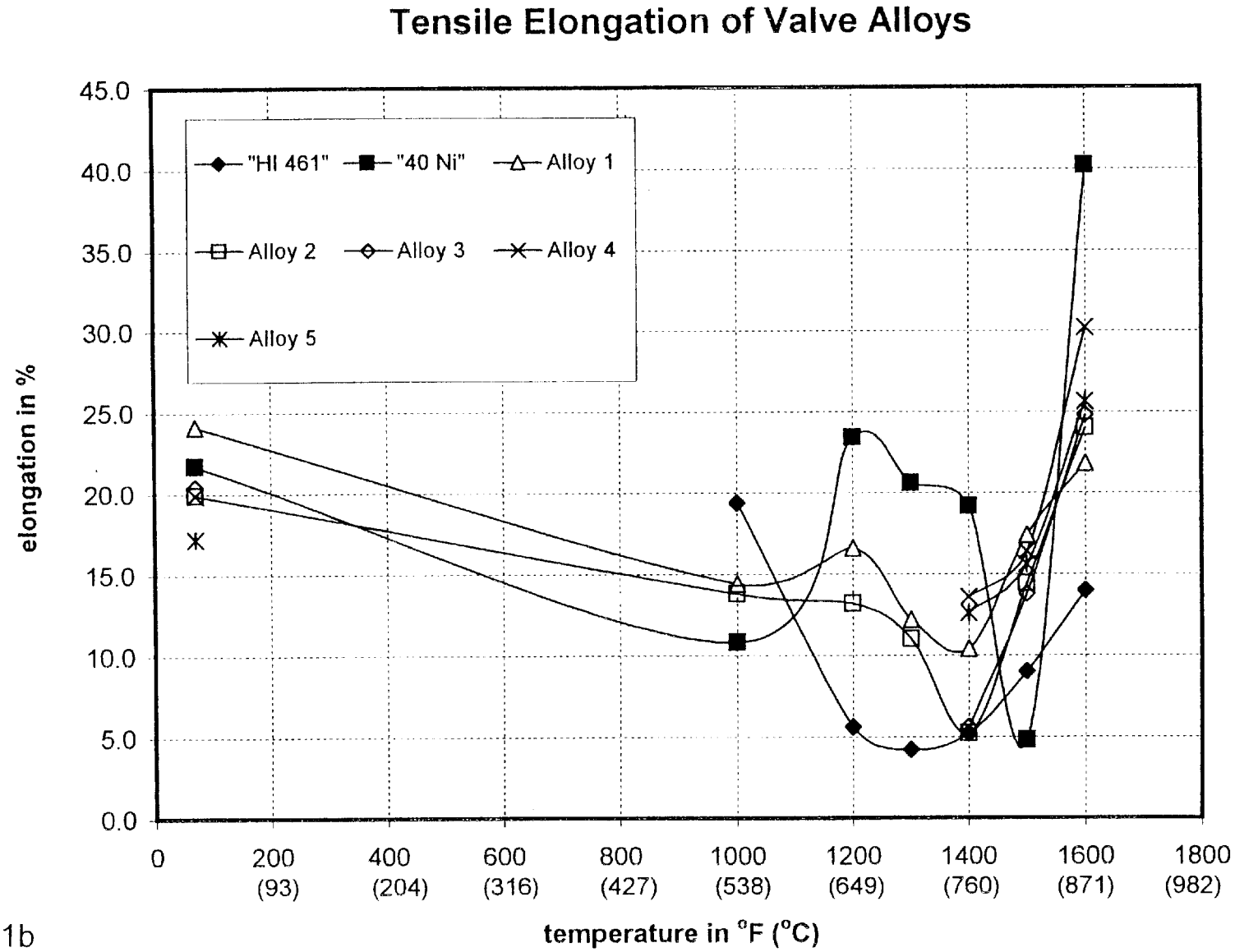
Figure 2:
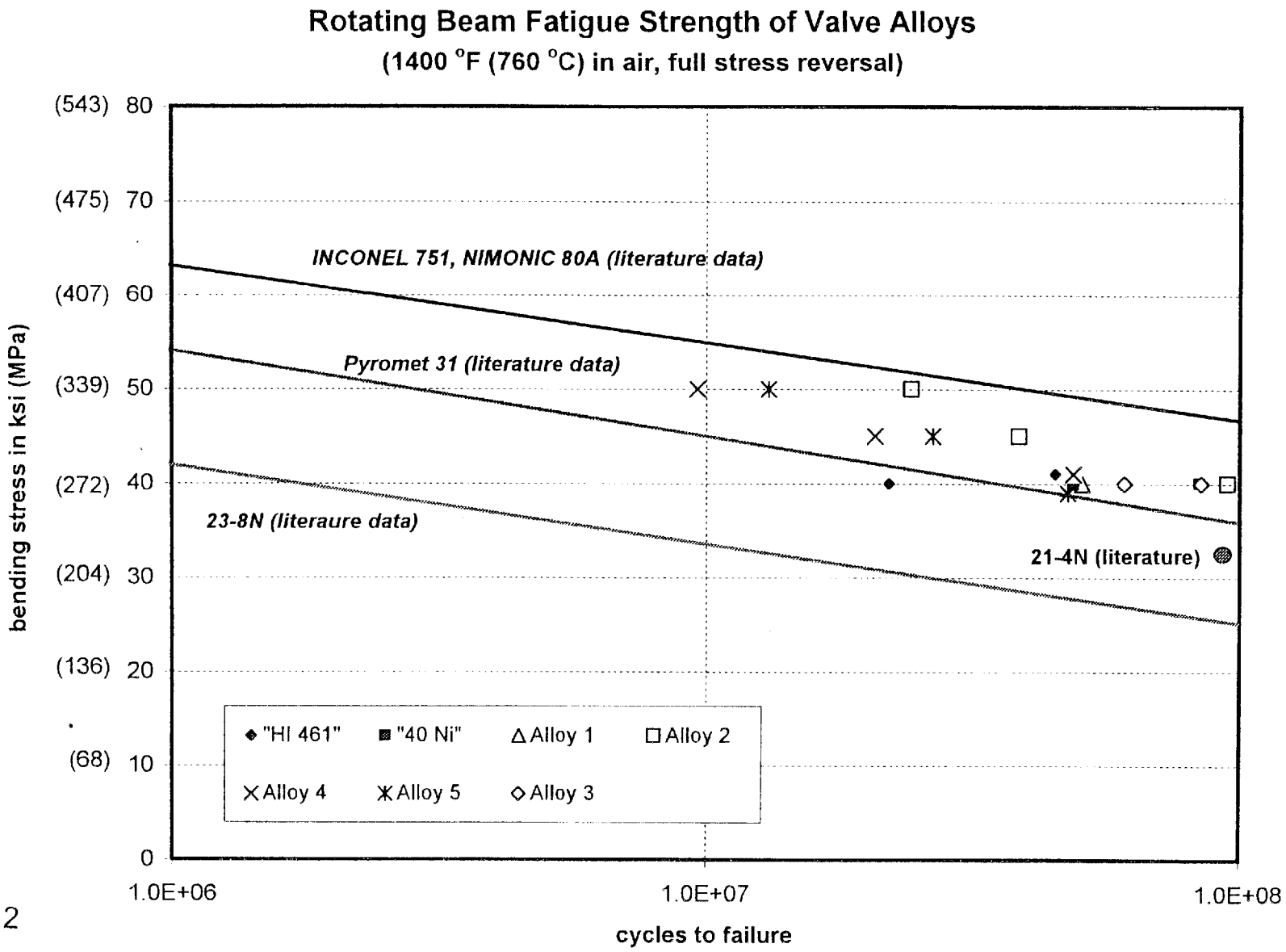
FIG. 2 is a graph of rotating beam fatigue strength versus cycles to failure showing fatigue data for Alloys 1–5 of the present invention and several comparative alloys.
Figure 3:
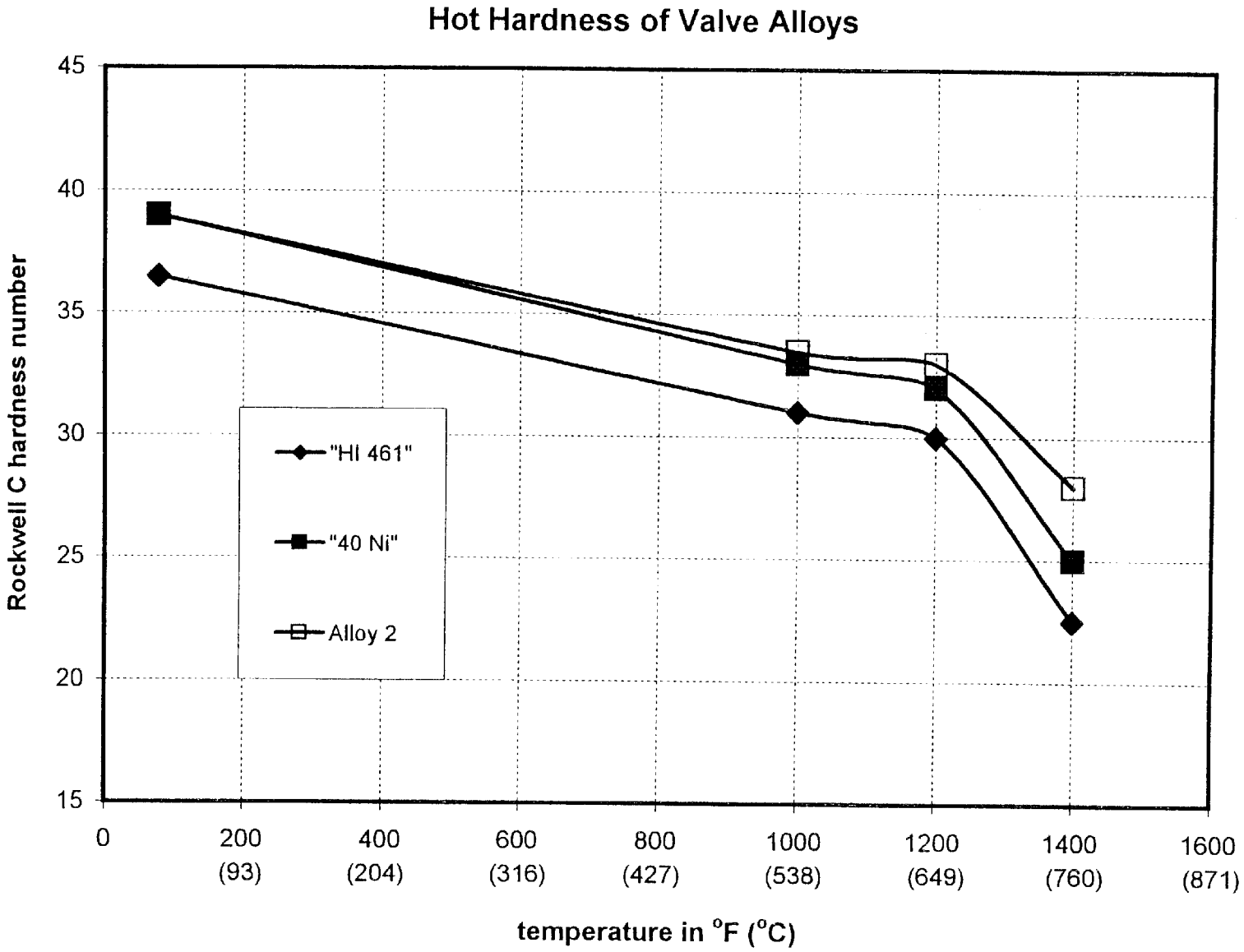
FIG. 3 is a graph of hardness versus temperature for Alloy 2 of the present invention and two comparative alloys.

In accordance with the invention, the chemical composition of the alloy is limited as described below.

C: 0.15–0.65 wt. %

Carbon (C) in the amounts present combines during melting with Nb and Ti to form (Nb,Ti)C-rich primary MC carbides. These primary carbides relatively uniformly disperse throughout the microstructure and provide primarily abrasion resistance in the alloy due to their hard, abrasive nature. If carbon is present in amounts of less than 0.15%, the volume fraction of these primary carbides is insufficient to cause the desired abrasion resistance. However, if carbon is present in amounts greater than 0.65%, the resulting carbides tend to cluster, thus impairing hot workability and valve surface quality.

Ni: 40–49 wt. %

Nickel (Ni) stabilizes the austenitic matrix phase and is essential for the formation of the strengthening γ' phase ($Ni_3(Al,Ti)$) utilized to impart heat resistance on the alloy. However, Ni is, on a cost basis, a relatively expensive alloying element (in comparison with Fe) and, hence, limited to less than 49 wt. %. The lower bound of 40 wt. % is determined by metallurgical stability considerations, i.e., the increasing propensity of the alloy to form harmful TCP (topologically close packed) phases, in particular sigma (σ) phase, upon extended service.

Cr: 18–22 wt. %

Chromium (Cr) is of paramount importance in imparting high-temperature oxidation and corrosion resistance to the alloy. Controlled laboratory tests simulating hot salt corrosion in an engine environment have shown that a minimum amount of 18 wt. % Cr is needed to attain satisfactory corrosion resistance. When Cr is added in amounts greater than 22 wt. %, however, the alloy becomes prone to massive intragranular precipitation of acicular phases, σ or α-Cr upon extended exposures to 760° C., thus harming ductility and toughness.

Cr contents in the above defined range can also be used to promote the precipitation of discrete secondary grain boundary carbides of the $M_{23}C_6$ type, thus increasing stress rupture strength.

Al: 1.2–1.8 wt. %

Aluminum (Al) is the primary hardening element leading in the above amounts present to the formation of γ' ($Ni_3(Al,Ti)$). For Al contents below 1.2 wt. %, the volume fraction of γ' is too small to meet the monotonic and fatigue strength targets. Contents of Al greater than 1.8 wt. % result, however, in increasing hot workability problems when forming the valves.

Ti: 2.0–3.0 wt. %

Titanium (Ti) is, next to Al, of utmost importance for the formation of γ'. Moreover, by virtue of increasing the anti-phase boundary energy of γ', alloying with Ti also results in a stronger precipitate, thus improving the overall strength of the alloy. On the other hand, exceedingly large amounts of Ti lead to phase instability, i.e., the precipitation of eta (η)-phase ($Ni_3Ti$). This η-phase is generally considered harmful for ductility. Hence, the Ti:Al wt. % ratio is limited to 2:1. The total combined amount of hardener elements (Al+Ti) is adjusted to balance strength requirements with fabricability of the alloy.

Nb: 0.9–7.8 wt. %

The primary purpose of alloying with niobium (Nb) is to cause precipitation of primary Nb-rich MC carbides. These Nb-rich carbides are more effective than Ti-rich MC carbides in increasing the abrasion resistance of the alloy owing to their higher hot hardness. To form these primary Nb-rich carbides, the Nb content is carefully balanced against the C content. At Nb:C weight ratios less than 6.5:1 or 6:1 (or 0.8:1 on an atomic basis), the primary carbides become increasingly Ti-rich, thus diminishing the positive effect on the abrasion resistance. At Nb:C ratios greater than 12:1 (or 1.5:1 on an atomic basis), the uncombined Nb tends to overalloy the austenitic matrix, thus raising the solvus temperature of harmful TCP phases above the valve operating temperature. Hence, the Nb:C weight % ratio should reside within the range of 6:1 to 12:1 or within the range of 0.8:1 to 1.5:1 on an atomic basis. A presently preferred broad range for Nb is about 0.9 to 7.8 wt. %, with a preferred intermediate range of 0.9 to 6.5 wt. % Nb and a narrow range of 1.8 to 5.5 wt. % Nb, or a more narrow range of 2.5 to 3.0 wt. % Nb.

Besides the aforementioned positive effect on abrasion resistance, Nb also improves the weldability of γ'-hardened superalloys and, likewise, increases corrosion resistance in sulfidizing environments, such as those encountered in diesel engines.

As stated above, Nb may be partially substituted for tantalum (Ta) on an equiatomic basis, cost permitting. Like Nb, Ta also strongly stabilizes the primary MC carbide and is surmised to be equally beneficial to hot hardness and abrasion resistance.

Co: not more than 1 wt. %

Cobalt (Co), despite its advantageous effects on strength and corrosion resistance in sulfur-containing environments, is a very expensive alloying element and should be kept as low as possible without driving up the cost of the Ni stock used for melting the alloy.

Mo: not more than 1 wt. %

Despite its generally positive effect on strength, molybdenum (Mo) at levels exceeding 1 wt. % impairs corrosion resistance in sulfur-containing environments at valve operating temperatures.

Mn: not more than 2 wt. %

The beneficial role of manganese (Mn) as a deoxidizing element is well-known in Ni-base alloys; however, amounts of Mn in excess of 2 wt. % will promote the formation of harmful phases.

B: not more than 0.01 wt. %

Boron (B) effectively improves the hot workability and creep rupture strength if present in small amounts. Excessive amounts of B, however, harm hot workability.

Zr: not more than 0.3 wt. %

Like boron, zirconium (Zr) is also effective in improving the hot workability and creep rupture strength if present in small amounts. Zr in excessive amounts, however, harms hot workability.

Si: not more than 1.0 wt. %

Silicon (Si) is an element effective in improving the oxidation resistance of the alloy. However, excessive additions of Si deteriorate the ductility of the material.

Fe: balance

Iron (Fe) is essentially a matrix-forming element and comprises the balance of the alloy including unavoidable or incidental impurities and trace elements in residual amounts.

A more narrow, presently preferred alloy composition according to the invention consists essentially of in % by weight: 0.25–0.55% C, 42–48% Ni, 19–21% Cr, 1.4–1.7% Al, 2.3–2.7% Ti, 1.8–5.5% Nb, the balance essentially Fe and incidental impurities, and wherein the Nb:C weight % ratio is about 7:1 to 10:1. The Nb range may be further narrowed to about 2.5–3.0 wt. %.

EXAMPLES

In order to demonstrate the attributes and advantages of the present invention, examples of the alloy of the invention and examples of comparative alloys are presented below.

Five alloys formulated according to the present invention, designated Alloy 1 through Alloy 5, and two comparative alloys mimicking HI® 461 and the 40 Ni alloy (designated "HI 461" and "40 Ni", respectively), were vacuum induction melted and cast into 22 kg (50 lb.) ingots. A conventional Ca+Mg deoxidation practice was used. The chemical compositions of the alloys are shown below in Table 1.

TABLE 1

Chemical composition (in wt. %) of examples of the alloy of the invention and comparative alloys

| Alloy | Fe | Ni | Cr | Al | Ti | Nb | C | Nb:C |
|---|---|---|---|---|---|---|---|---|
| 1 | bal. | 47.1 | 19.9 | 1.5 | 2.5 | 1.6 | 0.17 | 9.4 |
| 2 | bal. | 47.0 | 19.9 | 1.5 | 2.5 | 2.5 | 0.28 | 8.9 |
| 3 | bal. | 46.6 | 20.2 | 1.5 | 2.4 | 2.4 | 0.27 | 8.8 |
| 4 | bal. | 45.9 | 20.3 | 1.6 | 2.2 | 3.1 | 0.44 | 7.1 |
| 5 | bal. | 44.7 | 20.1 | 1.7 | 2.5 | 3.7 | 0.53 | 7.0 |
| HI 461 | bal. | 47.0 | 17.9 | 1.2 | 4.2 | <0.1 | 0.31 | <0.32 |
| 40 Ni | bal. | 41.1 | 16.0 | 0.9 | 2.9 | 0.8 | 0.02 | 40.0 |

Prior to hot rolling, all ingots were 2-step homogenized: 24 hours at 1149° C. (2100° F.) plus 24 hours at 1232° C. (2250° F.) and air cooled. The starting temperature for hot rolling was 1149° C. (2100° F.). All ingots were rolled without any apparent problems, even for the highest carbon level studied, in several passes including two reheats at intermediate size ovals to finally 15.9 mm (0.625") diameter rods.

These rolled rods subsequently received a two-step heat treatment consisting of a 1038° C. (1900° F.)/30 minutes solution anneal, followed by an air cool, and a 760° C. (1400° F.)/4 hour aging cycle, again followed by an air cool.

The following tests were performed on such heat treated material, the results of which are shown in FIGS. 1–5 and discussed below.

Room temperature and elevated temperature tensile tests were conducted to assess the strength and ductility potentials of the alloys. The results of these tests are graphically depicted in FIGS. 1*a* and 1*b*. As can be seen, the tensile strength of the alloys of the present invention is of the same magnitude as that of the comparative alloys. The same is true for the ductility, i.e., tensile elongation reported in FIG. 1*b*. The ductility minimum observed in the vicinity of 760° C. (1400° F.) is typical of many superalloys.

Elevated temperature high-cycle rotating beam fatigue tests at 760° C. (1400° F.) to establish the fatigue strength limit at $10^8$ cycles are reported in FIG. 2. The cycles were carried out under full stress reversal. S—N curves for 23-8N, 21-4N, Pyromet® 31V and alloy 751/NIMONIC® alloy 80A as obtained from the literature are superimposed. This test is generally considered a benchmark test by engine manufacturers. An equivalent to enhanced fatigue performance of the alloys of the present invention over the stainless steels, HI® 461 and the 40 Ni alloy and even Pyromet® 31V is apparent. Not surprisingly, the performance level of the high cost Ni-base superalloys like alloy 751 could not be met with the low cost alloy of this invention. This, however, was not the aim of the present invention.

Hot hardness tests up to 760° C. (1400° F.) using a Rockwell A tester and converting the hardness numbers to Rockwell C are reported in FIG. 3 to rank the alloys in terms of their abrasion resistance. The highest hot hardness was measured on an alloy of this invention, thus demonstrating a superior abrasion resistance of this alloy over the comparative alloys. It can, hence, be expected that hardfacing the alloy of this invention will not be necessary.

Figure 4A:
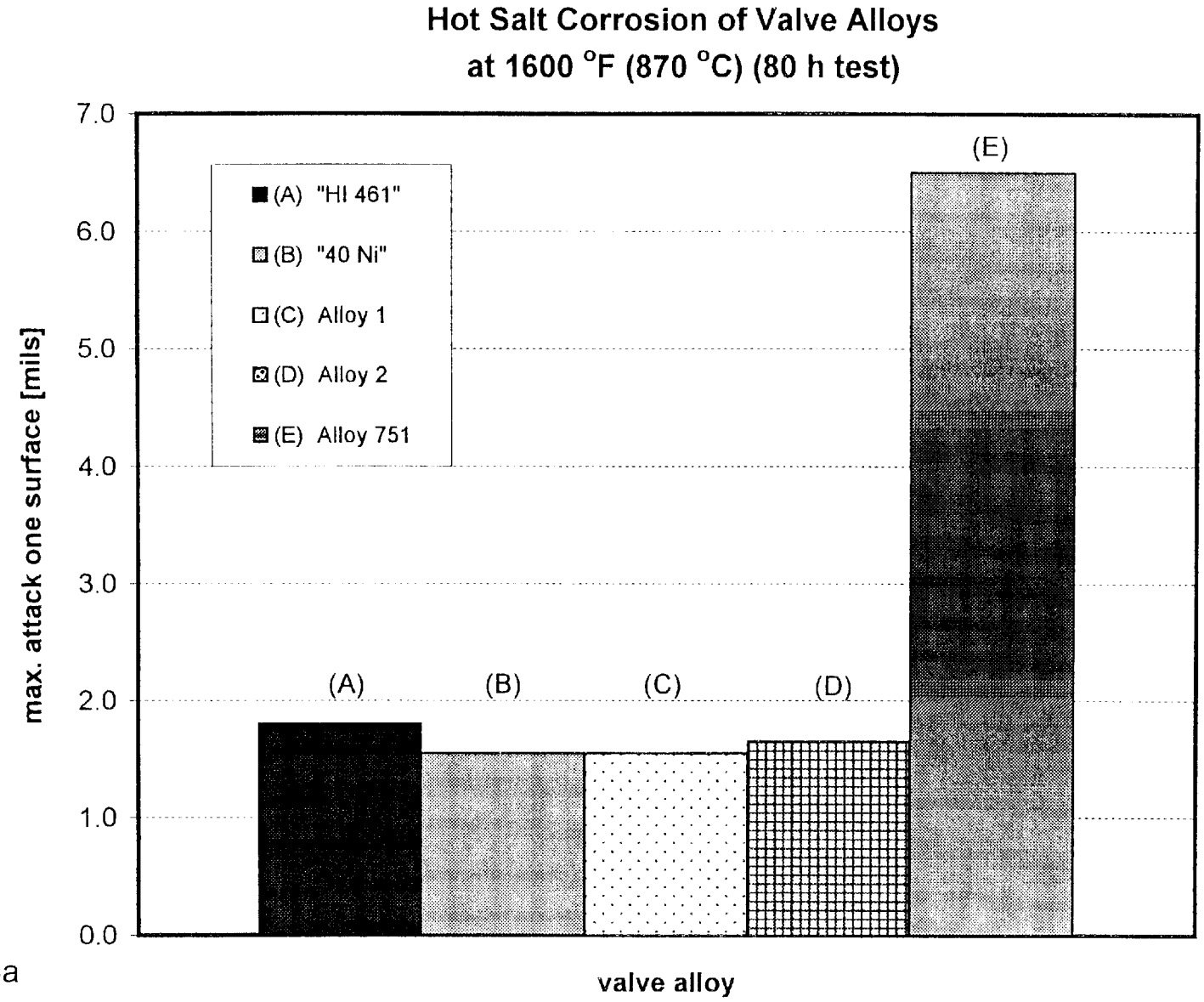
FIGS. 4*a*–4*c* are bar graphs depicting hot salt corrosion attack on alloys of the present invention and several comparative alloys.
Figure 4B:
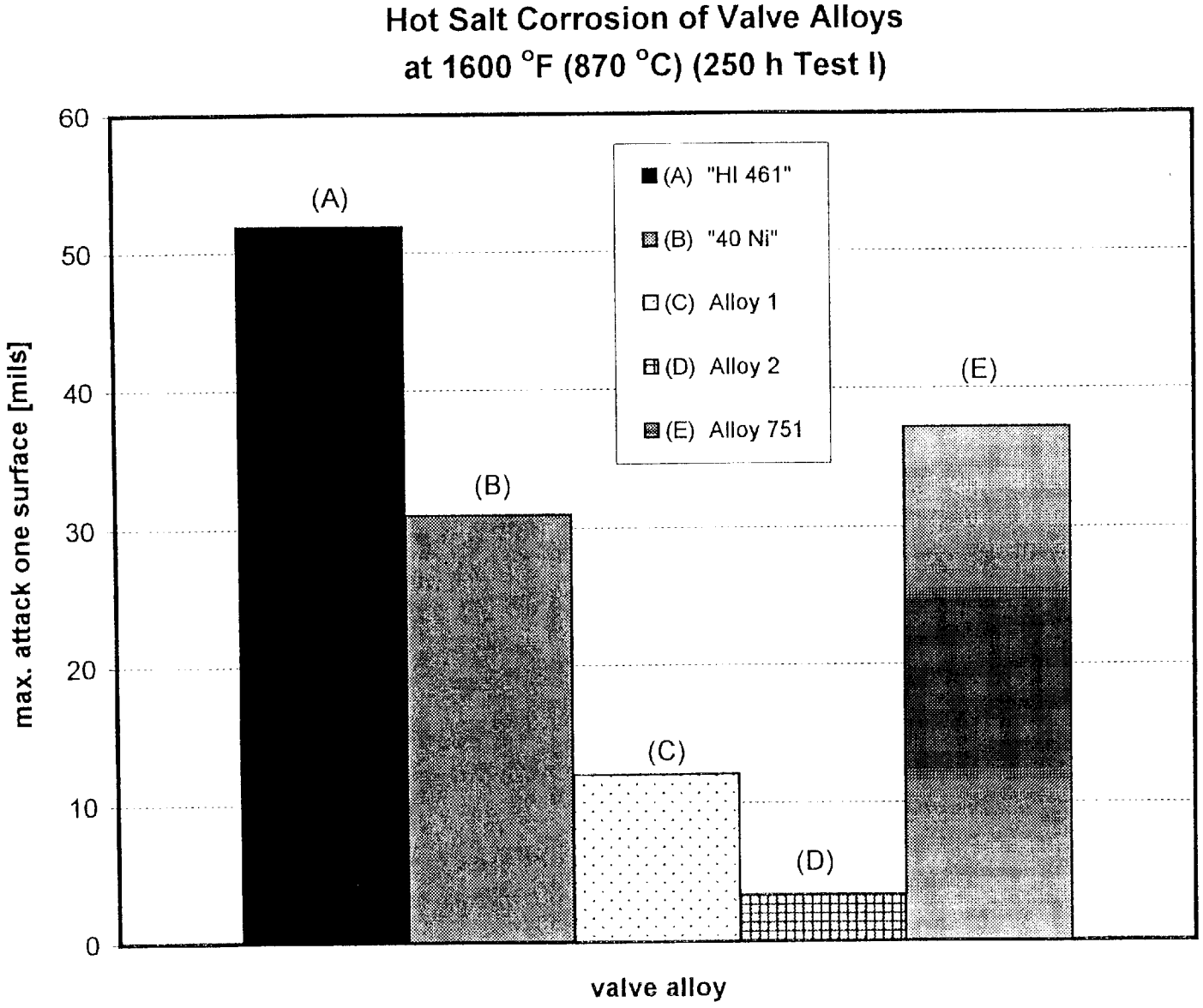
Figure 4C:
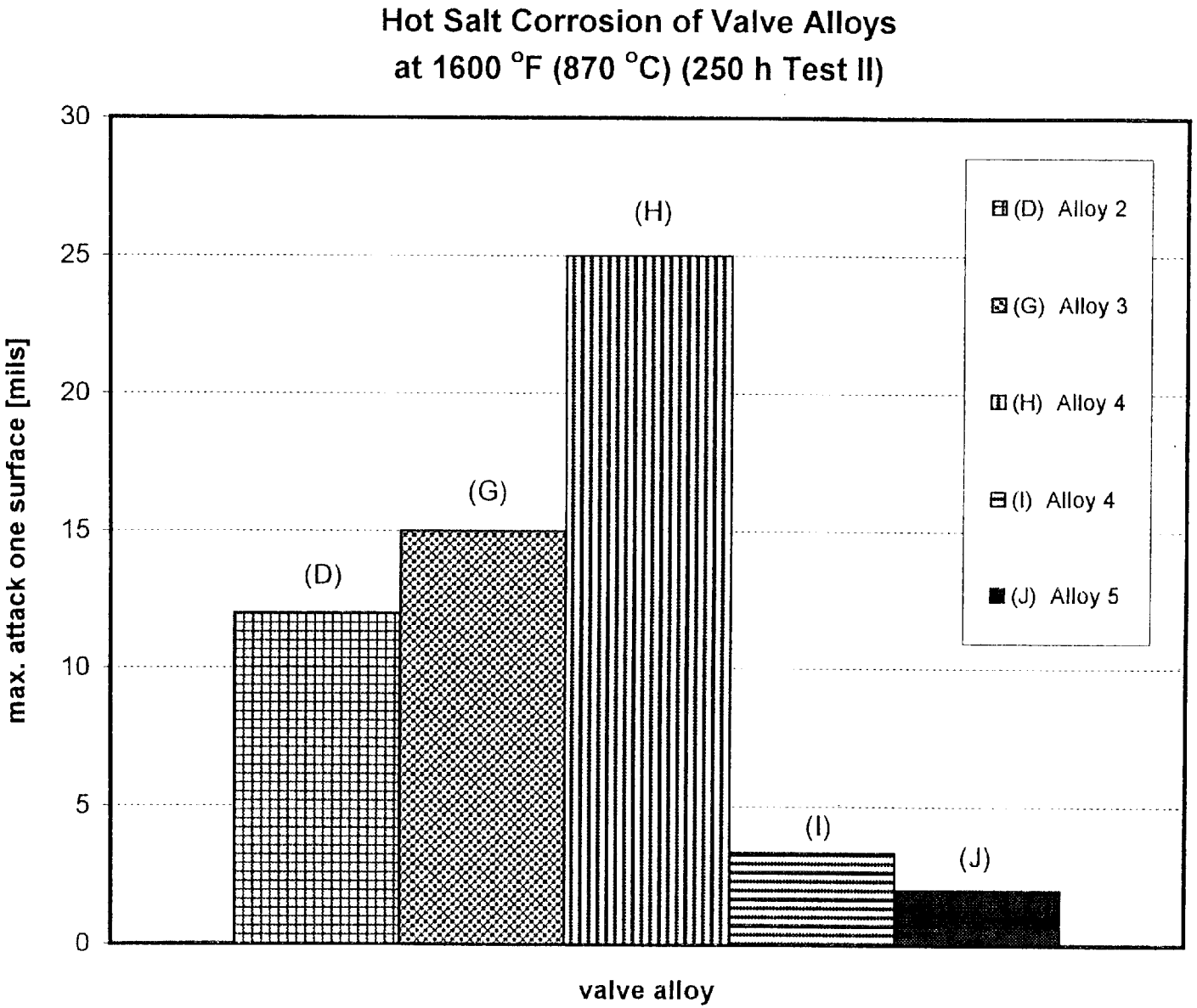
Figure 5A:
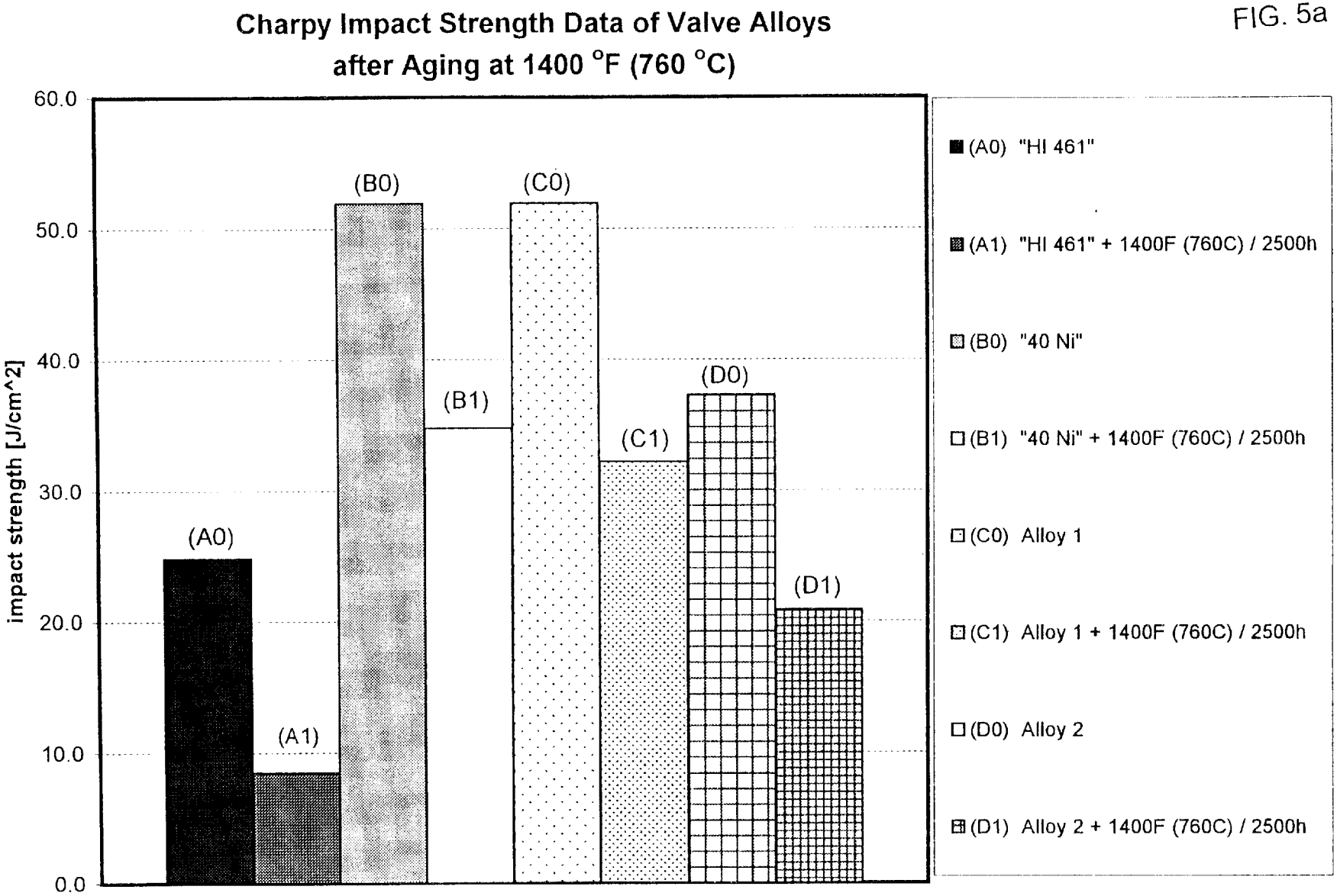
FIGS. 5*a* and 5*b* are bar graphs showing Charpy impact strength of alloys of the invention and comparative alloys.
Figure 5B:
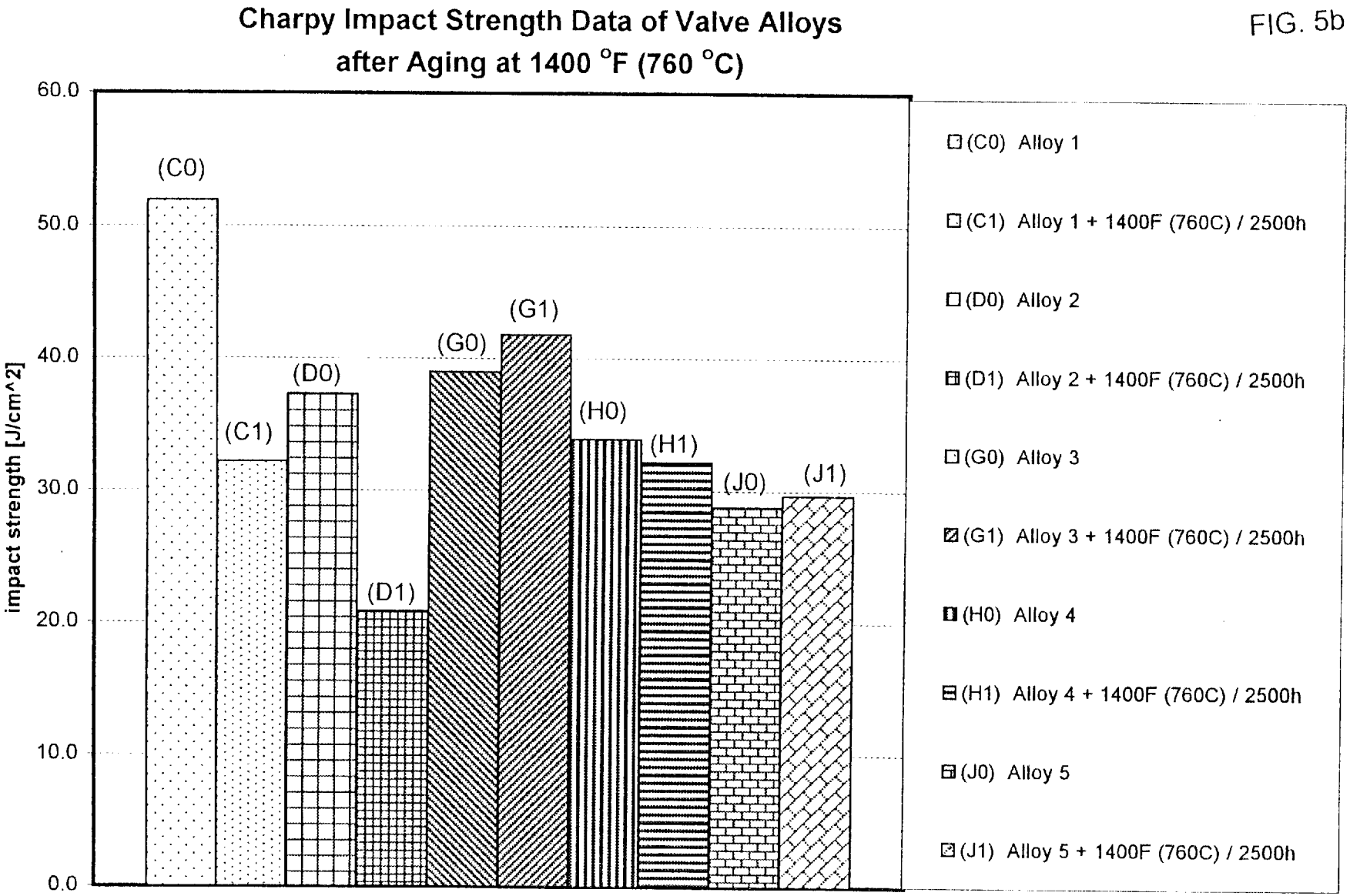

Hot salt corrosion tests (an 80-hour standard, and a 250-hour aggravated test) in a mixture of $CaSO_4$:$BaSO_4$:$Na_2SO_4$:C in a ratio of 10:6:2:1, respectively, at a temperature of 870° C. (1598° F.) are reported in FIGS. 4*a*, 4*b* and 4*c*. As will be appreciated, the longer the bar graphs on FIGS. 4*a*–*c*, the poorer the corrosion resistance of the particular alloy tested. Each alloy tested is listed in the box appearing on each of FIGS. 4*a* and *b* wherein alloy HI 461 is identified with the letter "(A)", alloy 40 Ni as "(B)", alloy 1 of the invention as "(C)", alloy 2 of the invention as "(D)", and alloy 751 as "(E)". In FIG. 4*c*, alloys 2–5 of the present invention are identified as follows: alloy 2 as "(D)", alloy 3 as "(G)", alloy 4 as "(H)" and "(I)" (duplicate test) and alloy 5 as "(J)". The samples were recoated at 80 hour intervals. This is one of the tests believed to be crucial as a measure of valve performance. In the 80-hour, standard test depicted in FIG. 4*a*, both the alloys of this invention (C) and (D) and the comparative alloys (A) and (B) showed, presumably due to their higher Fe content, significantly less attack than the high Ni alloy 751 (E). Further discrimination resulted from the aggravated 250-hour tests of FIGS. 4*b* and 4*c*. In this aggravated test, the superior corrosion resistance of the alloys of the present invention, especially of the alloys of the preferred embodiment, became very apparent.

Figure 6:
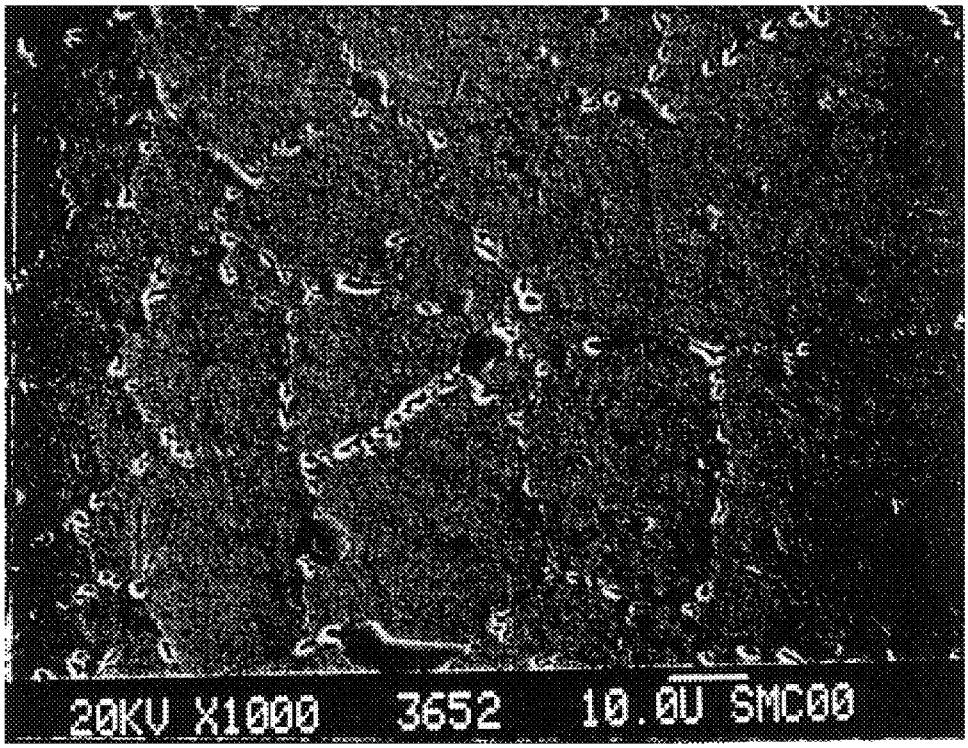
FIG. 6 is a scanning electron photomicrograph of Alloy 2 of the invention after 2,500 hours' exposure to a temperature of 1400° F. (760° C.).

Metallurgical stability tests by means of long-term exposures to 760° C. (1400° F.) up to 2,500 hours and subsequent Charpy impact testing as a sensitive indicator of potential embrittlement are reported in FIG. 5, assisted by metallographic evaluation of the exposed microstructures shown in FIG. 6. Again, the alloys of the present invention exhibit at least an equivalent retention of toughness as the comparative alloys upon long-term exposures. This is consistent with the metallographic inspections of FIG. 6 in that only minuscule amounts, if any, of intragranular acicular phase formed during aging. Furthermore, the grain boundary carbides remained discrete in nature and, thus, in a preferred morphology.

Although only selected examples of the alloy of this invention have been presented, it is understood that it is possible to practice the invention in various forms without departing from the spirit and scope of this invention.

What is claimed is:

1. A heat and corrosion resistant alloy composition useful for diesel engine components, comprising in weight percent: 0.15–0.65% C, 40–49% Ni, 18–22% Cr, 1.2–1.8% Al, 2.0–3.0% Ti, 0.9–7.8% Nb, not more than 1% Co and Mo each, the balance being essentially Fe and incidental impurities, wherein a Ti:Al weight percent ratio is ≦2:1 and a Nb:C weight percent ratio is within a range of 6:1 to 12:1 on a weight percent basis and between 0.8:1 to 1.5:1 on an atomic basis.

2. The alloy of claim 1, wherein Nb is partially substituted by Ta on an equiatomic basis.

3. The alloy of claim 1 wherein the Nb content is 0.9–6.5%.

4. The alloy of claim 1 comprising: 0.25–0.55% C, 42–48% Ni, 19–21% Cr, 1.4–1.7% Al, 2.3–2.7% Ti, 1.8–5.5% Nb, the balance being essentially Fe and incidental impurities, wherein the Nb:C weight percent ratio is adjusted to lie within 7:1 and 10:1.

5. The alloy of claim 4, wherein Nb is partially substituted by Ta on an equiatomic basis.

6. The alloy of claim 1, wherein the Nb content is 2.5–3.0%.

7. A diesel engine valve made from an alloy comprising in weight percent: 0.15–0.65% C, 40–49% Ni, 18–22% Cr, 1.2–1.8% Al, 2.0–3.0% Ti, 0.9.–7.8% Nb, not more than 1% Co and Mo each, the balance being essentially Fe and incidental impurities, wherein a Ti:Al weight percent ratio is ≦2:1 and a Nb:C weight percent ratio is within a range of 6:1 and 12:1 and between 0.8:1 to 1.5:1 on an atomic basis.

8. The diesel engine valve of claim 7, wherein Nb is partially substituted by Ta on an equiatomic basis.

9. The diesel engine valve of claim 7, wherein the Nb content is 0.9–6.5%.

10. The diesel engine valve of claim 7 comprising: 0.25–0.55% C, 42–48% Ni, 19–21% Cr, 1.4–1.7% Al, 2.3–2.7% Ti, 1.8–5.5% Nb, the balance being essentially Fe and incidental impurities, whereby a Nb:C weight percent ratio is within a range of 7:1 to 10:1.

11. The diesel engine valve of claim 10, wherein Nb is partially substituted by Ta on an equiatomic basis.

12. The diesel engine valve of claim 7, wherein the Nb content is 2.5–3.0%.

* * * * *